US005978997A

United States Patent [19]

Grossman

[11] Patent Number: 5,978,997

[45] Date of Patent: Nov. 9, 1999

[54] COMPOSITE STRUCTURAL MEMBER WITH THIN DECK PORTION AND METHOD OF FABRICATING THE SAME

[76] Inventor: Stanley J. Grossman, 10408 Greenbriar Pl., Oklahoma City, Okla. 73159

[21] Appl. No.: 08/898,230

[22] Filed: Jul. 22, 1997

[51] Int. Cl.[6] ..... E01D 2/00

[52] U.S. Cl. ..... 14/73; 14/77.1; 52/334

[58] Field of Search ..... 14/73, 73.1, 73.5, 14/77.1, 74.5; 52/333, 334, 337, 414, 602; 249/1, 2

[56] References Cited

U.S. PATENT DOCUMENTS

| | | | |
|---|---|---|---|
| 2,096,629 | 10/1937 | Farrar et al. . | |
| 2,725,612 | 12/1955 | Lipski . | |
| 2,730,797 | 1/1956 | Lipski . | |
| 3,251,167 | 5/1966 | Curran . | |
| 3,282,017 | 11/1966 | Rothermel . | |
| 3,577,504 | 5/1971 | Lipski | 264/255 |
| 3,588,971 | 6/1971 | Lipski . | |
| 3,608,048 | 9/1971 | Lipski | 264/228 |
| 3,618,889 | 11/1971 | Lipski | 249/50 |
| 4,493,177 | 1/1985 | Grossman | 52/745.2 |
| 4,531,857 | 7/1985 | Bettigole | 404/44 |
| 4,646,493 | 3/1987 | Grossman . | |
| 4,700,516 | 10/1987 | Grossman . | |
| 4,741,138 | 5/1988 | Rongoe, Jr. | 52/334 |
| 4,780,021 | 10/1988 | Bettigole | 404/72 |
| 4,865,486 | 9/1989 | Bettigole | 404/75 |
| 4,972,537 | 11/1990 | Slaw, Sr. | 14/73 X |
| 5,144,710 | 9/1992 | Grossman | 14/73 |
| 5,301,483 | 4/1994 | Grossman | 52/223.7 |
| 5,305,575 | 4/1994 | Grossman | 52/745.2 |
| 5,509,243 | 4/1996 | Bettigole et al. | 52/334 |
| 5,617,599 | 4/1997 | Smith | 14/73 |

FOREIGN PATENT DOCUMENTS

| | | |
|---|---|---|
| 851074 | 10/1952 | Germany . |
| 1124075 | 2/1962 | Germany . |
| 737545 | 6/1980 | U.S.S.R. . |
| 1474201 | 4/1989 | U.S.S.R. . |

OTHER PUBLICATIONS

Exhibit A—Drawing of prior art bridge built in Kiowa County, Oklahoma, around 1987.

*Primary Examiner*—David Bagnell
*Assistant Examiner*—Sunil Singh
*Attorney, Agent, or Firm*—McAfee & Taft

[57] ABSTRACT

A composite structural member with a thin deck portion. The composite structural member comprises a plurality of longitudinally extending girders with a plurality of composite members disposed thereon. The composite structural member comprises a plurality of transversely extending beams with a molded deck structure thereon. In one embodiment, the composite member is a prefabricated composite unit which is installed on the girders and attached thereto. In a second embodiment, the beams are positioned on the girders, and the deck portion is poured in place. In both embodiments, the molded deck portion is substantially thinner than for the prior art structures, but the present invention has greater strength characteristics. A preferred thickness of the deck portion is in the range of about 4 inches to less than about 6.5 inches, with a preferred thickness of five inches. The thickness of the deck portion is such that a single layer of reinforcing material may be used.

31 Claims, 4 Drawing Sheets

COMPOSITE STRUCTURAL MEMBER WITH THIN DECK PORTION AND METHOD OF FABRICATING THE SAME

BACKGROUND OF THE INVENTION

1. Field of the Invention

This invention relates in general to structural members and methods of forming structural members, and more particularly, to a composite structural member, such as a bridge unit, which has a relatively thin molded deck portion adaptable for use on original structures and refurbished structures.

2. Description of the Prior Art

In the prior art there are a wide variety of structural members, both prefabricated and fabricated in place. These structural members include single element members, such as steel beams, and composite structural members with molded materials reinforced with, or supported by, metal bars or structural beams, girders or other elements. A typical molded material for the deck portions of these structures is concrete.

In forming structural members for spanning between two supports, it has often been found desirable to utilize a steel structural support beneath a molded concrete deck surface. Because steel can withstand a much higher tensile strength, these composite structural members are formed with a steel sustaining most of the tensile stress which is placed on the composite member.

To form composite members of the type having an upper concrete surface and a metal support underneath, a metal piece form mold typically is utilized. First, the steel supports, such as wide flange girders, are placed beneath a mold assembly having two or more mold pieces disposed around the girder or girders. Next, the concrete is poured into the mold such that the concrete fills the mold and extends over the girder. When the concrete is hardened, the mold pieces are disassembled from around the girders such that the concrete rests on the girders. In most instances, these wide flange girder-supported concrete structural members are formed in place. This is usually advantageous so the concrete surface can better fit into the finished structure. The concrete deck portion is attached to the beams by shear connectors which are molded into the concrete, or which extend into openings in the concrete which are then grouted in place.

In such composite structures, the concrete deck portion must be sufficiently thick to support the load applied thereto. Such loads include the weight of the concrete itself and any external loads which are applied, such as traffic on a bridge. The volume of concrete in such structures makes them quite heavy, and the cost of building such structures is usually high.

There is a need, therefore, for a lighter weight, less expensive structure which provides at least strength characteristics which are at least as high as prior structures. The present invention utilizes a considerably thinner concrete deck portion but shows the same or better strength properties.

A problem with all composite structures is that they eventually need repair. Over time, the loading on the concrete tends to cause cracking and other damage. This is particularly true in applications where the loading varies, such as traffic flowing over a bridge structure. Eventually, the composite structure must be refurbished. In many cases, this requires removal of the original molded deck portion and replacement thereof. If the replacement deck is made in the conventional manner, by molding a new thick deck portion, the procedure is very time consuming. This is of particular significance in the refurbishment of structural members such as bridges because it is desirable to keep the interruption of traffic to a minimum.

The present invention can be built in place but includes an embodiment utilizing prefabricated composite units which can be positioned on the old girders and attached thereto much more quickly than the time necessary to rebuild the original type of thick deck portion. In addition, the composite units have a substantially thinner deck portion and yet provides greater strength so that the replacement structure is slightly stronger and lighter than the original.

SUMMARY OF THE INVENTION

The present invention is a composite structural member with a thin deck portion compared to prior structures. The invention is particularly well adapted for bridge structures, but is not intended to be so limited.

The invention may be described as a structural apparatus comprising a plurality of girders extending in a longitudinal direction with the girders being spaced from one another in a transverse direction with respect to the girders and a composite member disposed above the girders. The composite member comprises a plurality of beams extending in the transverse direction, a plurality of beam shear connectors attached to the beams, and a molded deck portion molded around the beam shear connectors. The deck portion is disposed at least partially above the beams. The apparatus further comprises means for connecting the composite member to the girders.

In one embodiment, the composite member comprises a plurality of composite units which are positioned adjacent to one another on the girders. Preferably, the composite units are prefabricated, although they may be poured in place. In one preferred embodiment, the composite units are prefabricated by forming them in an inverted position.

In the first embodiment, the deck portions of the composite units define a plurality of openings therein with each opening being aligned with a gap defined between a pair of adjacent beams. The means for connecting in this embodiment comprises a bulkhead disposed in each of the gaps and aligned with a corresponding one of the openings, a girder shear connector attached to each girder and extending into corresponding ones of the bulkheads and openings, and a grouting material filling the bulkheads and openings and surrounding the girder shear connectors.

In a second embodiment, the molded deck portion of the composite member is poured in place on the beams. In this embodiment, the means for connecting comprises a girder shear connector attached to each girder and extending therefrom, and a support portion extending downwardly from the deck portion and integral therewith which is molded around the girder shear connectors.

The molded deck portion of either embodiment is preferably made of concrete and has a thickness in the range of about 4 inches to less than about 6.5 inches. One preferred embodiment has a thickness of approximately five inches. The deck portion may have a thickness greater or less than a height of the beam.

Preferably, a single layer of reinforcing material is disposed in the molded deck portion with the material of the deck portion molded around the reinforcing material as well as the beam shear connectors.

The present invention also comprises a method of refurbishing a structural apparatus having an original molded deck portion disposed above and connected to a plurality of longitudinally extending girders. In one embodiment, the method comprises the steps of prefabricating a plurality of the composite units previously described, removing the original deck portion, positioning the composite units on the girders such that the beams extend in a transverse direction with respect to the girders, and attaching the composite units to the girders. The composite units are positioned adjacent to one another such that the unit deck portions of the composite units form a substantially continuous upper surface. In this method, the step of attaching preferably comprises filling an opening in each of the unit deck portions with grouting material such that the grouting material substantially surrounds girder shear connectors attached to the girders and extending into corresponding ones of the openings.

In a second embodiment, the method comprises removing the original deck portion, positioning a plurality of beams on the girders such that the beams extend in a transverse direction with respect to said girders, molding a new deck portion around beam shear connectors extending from the beams and substantially above said beams, and attaching the new deck portion to the girders. The new deck portion is preferably molded with a thickness in the range of about 4 inches to less than about 6.5 inches and with a combined height of a new deck portion and beams which is approximately equal to a height of the original deck portion. The step of attaching comprises attaching a plurality of girder shear connectors to the girders and substantially simultaneously with the step of molding the deck portion, molding a downwardly extending support portion of the deck portion around the girder shear connectors.

Either method may further comprise the step of positioning a shim between each of the beams and the corresponding girders.

Numerous objects and advantages of the invention will become apparent as the following detailed description of the preferred embodiment is read in conjunction with the drawings which illustrate such embodiment.

BRIEF DESCRIPTION OF THE DRAWINGS

FIG. 3 is an elevational view of a first embodiment of the composite structural member with thin deck portion of the present invention requiring a single layer of reinforcing material.

DESCRIPTION OF THE PREFERRED EMBODIMENT

Figure 1:
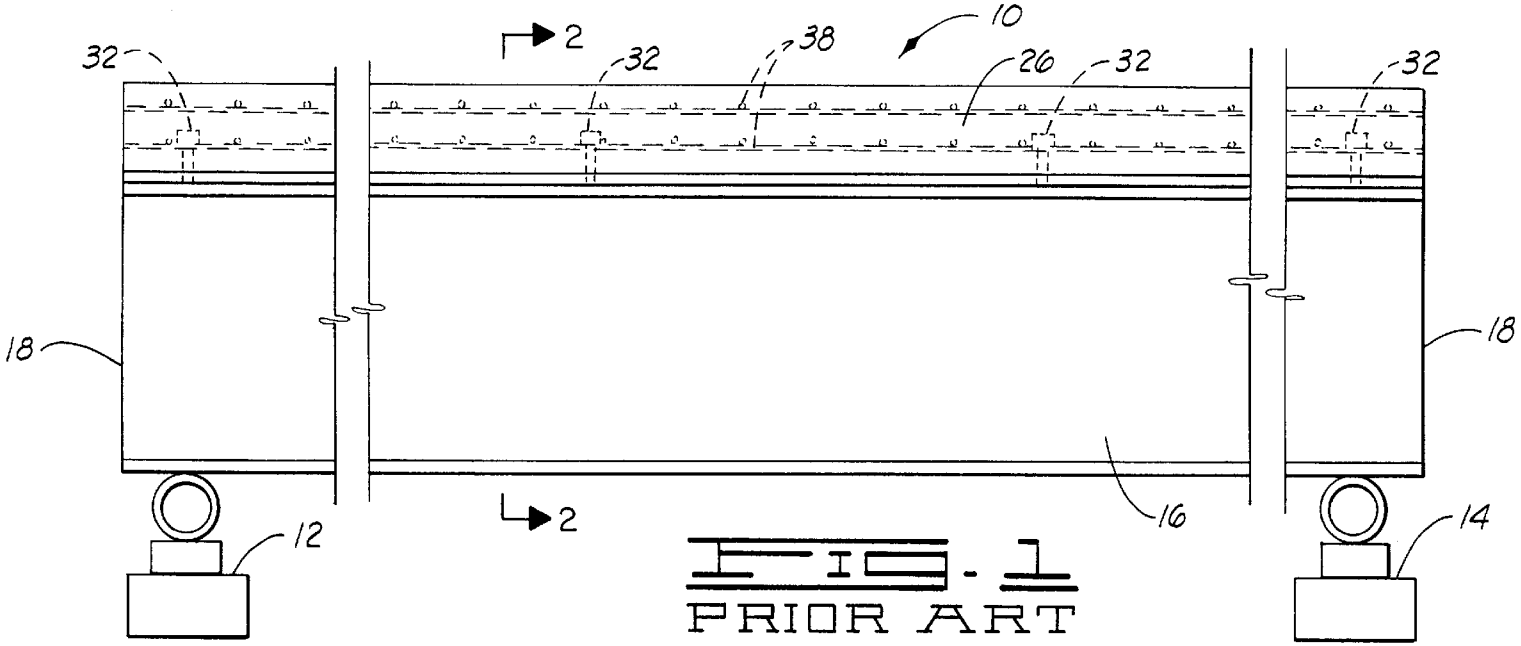
FIG. 1 PRIOR ART
FIG. 1 shows an elevation view of a prior art composite structural member having a thick molded deck portion requiring at least two layers of reinforcing material.
Figure 2:
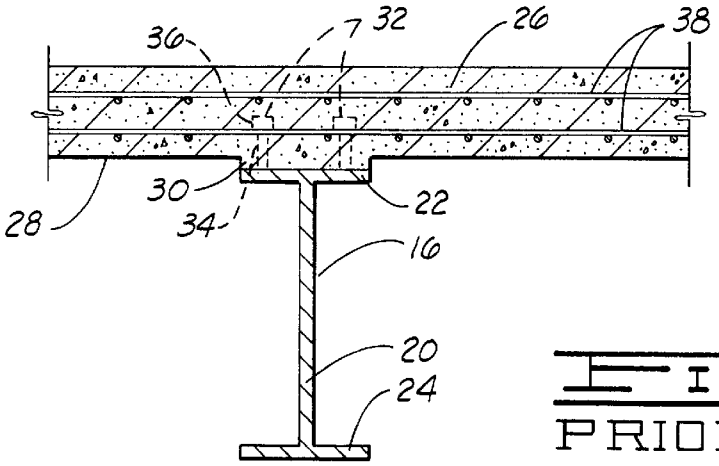
FIG. 2 PRIOR ART
FIG. 2 is a cross section of the prior art structure taken along lines 2—2 in FIG. 1.

Referring to FIGS. 1 and 2, a prior art composite structure is generally designated by the numeral 10. In the embodiment shown, prior art member 10 is a bridge structure adapted for extending between a pair of abutments or supports 12 and 14 disposed on opposite sides of whatever is to be bridged, such as a river (not shown).

Member 10 comprises a plurality of longitudinally extending girders 16 which generally have an I-beam configuration. Girders 18 are positioned and supported on abutments 12 and 14 adjacent to longitudinally opposite ends 18 of the girders. As best seen in FIG. 2, each girder 16 has a vertically extending central portion 20 with horizontal upper and lower flange portions 22 and 24.

Disposed above girders 16 is a molded deck portion 26 which is made of a moldable material such as concrete. A lower surface 28 of deck portion 26 is spaced above upper flange 22 of girder 16 by a downwardly extending haunch portion 30. Haunch portion 30 is an integral part of deck portion 26.

Extending upwardly from the top of girders 16 are a plurality of shear connectors 32. Shear connectors 32 are fixedly attached to the top of upper flanges 22 of girders 16. Each shear connector 32 preferably has a shank portion 34 with an enlarged head portion 36 at the outer end thereof. Other kinds of connectors are also generally known. Deck portion 26 is formed and placed on girders 16 such that the molded material forming the deck portion is molded around shear connectors 32 thus forming a locking attachment between deck portion 26 and girders 16. Once the molded material has hardened, a composite structure is formed.

Figure 4:
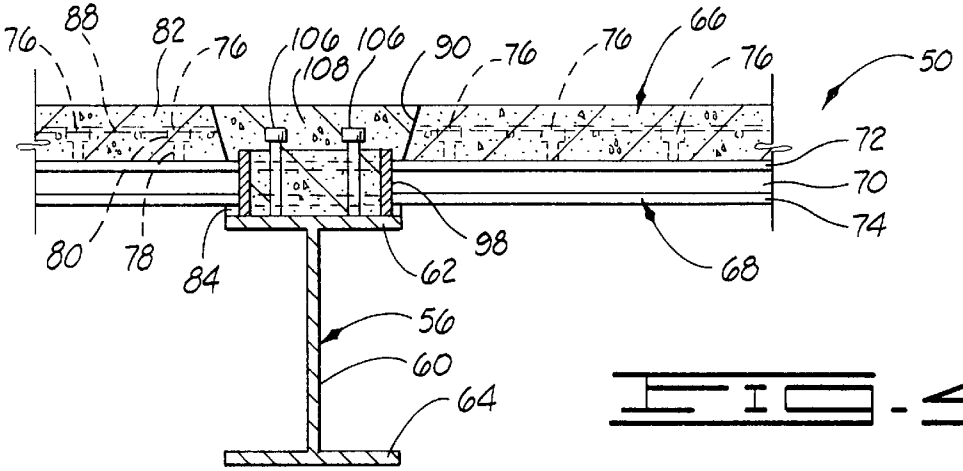
FIG. 4 is a partial cross section taken along lines 4—4 in FIG. 3.
Figure 5:
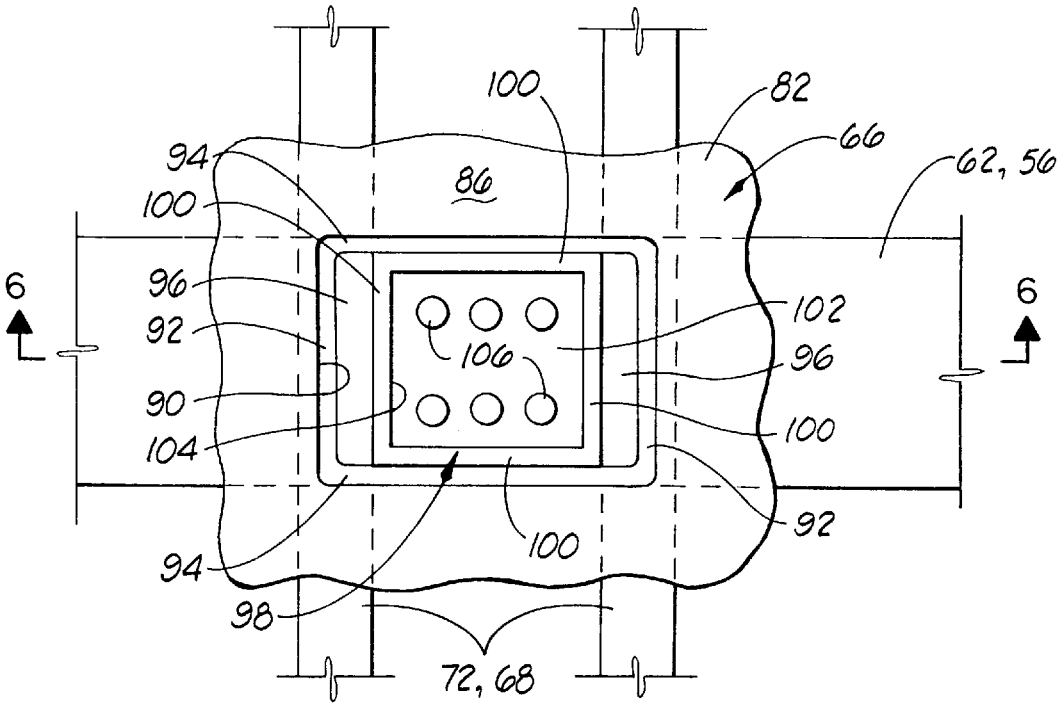

Referring now to FIG. 4, a first embodiment of the composite structural member with said thin deck portion of the present invention is shown and generally designated by the numeral 50. The illustrated embodiment shows structural member 50 as a bridge. Structural member 50 which may also be referred to as a structural apparatus 50 is also positioned on a pair of known supports or abutments 52 and 54 which are of conventional type.

Member 50 comprises a plurality of longitudinally extending girders 56 which are supported on abutments 52 and 54 adjacent to longitudinal ends 58 of the girders. Each girder 56 has a vertically extending central portion 60 with upper and lower horizontal flange portions 62 and 64 on opposite sides thereof. It will thus be seen that girders 56 are substantially similar or identical to girders 16 in prior art structural member 10.

Structural member 50 also comprises a plurality of composite members or units 66, also referred to as transverse members, units or sections 66, which are positioned on upper flanges 62 of girders 56. Each transverse unit 66 extends transversely between girders 56.

Each transverse unit 66 comprises a plurality of transversely extending beams 68 which extend substantially the entire transverse width of each section 66. Beams 68 are preferably of I-beam configuration having a vertically extending central portion 70 and upper and lower horizontal flange portions 72 and 74, as best seen in FIG. 3. Beams 68 can also have a rectangular or square tube configuration.

Extending from the top of beams 68 are a plurality of beam shear connectors 76. Beam shear connectors 76 are fixedly attached to upper flange 72 of beams 68. Each beam shear connector 76 preferably has a shank portion 78 with an enlarged head portion 80 at the outer end thereof, but other kinds of connectors generally known in the art may also be used.

Each transverse unit 66 further comprises a molded unit deck portion 82. Molded deck 82 is made of concrete or similar material and is molded around beam shear connectors 76 on the upper flanges 72 of beams 68 to form a composite structure. Preferably, but not by way of limitation, deck 82 is molded such that the deck is prestressed in a manner wherein upper surface 86 of the deck is placed in compression.

One such method of forming composite units 66 is that described in U.S. Pat. No. 4,493,177, a copy of which is incorporated herein by reference. Using this method, each composite unit is constructed in an inverted position such that the downward deflection of beams 68 and the mold for forming deck 82 may have downward deflection. The mold is filled with a moldable material, such as concrete, which hardens to form a composite structural member with transverse beams 68. During hardening of the moldable material, the mold is deflected so that beams 68 are placed in a stressed condition to form a composite, prestressed structural unit 66 upon hardening of the moldable material. Once hardening has occurred, the unit is inverted. When so inverted and supported at outer ends of beams 68, the center portion of the structure will be free to deflect downwardly due to its own weight and due to any loads placed thereon so that the moldable material is substantially always in compression. Thus, the resulting composite, prestressed units 66 can then be used in member 50.

At least one shim 84 is disposed between lower flange 74 of each beam 68 and upper flange 62 of the corresponding girders 56. The appropriate number of shims 84 is used so that upper surfaces 86 of each deck portion 82 are aligned to form a substantially continuous upper surface 86 for structural member 50.

Deck portion 82 of structural member 50 is substantially thinner than prior art deck portions, such as deck 26 in prior art structural member 10. Deck 82 is sufficiently thin that a single layer 88 of reinforcing material is all that is required to add sufficient strength to the moldable material.

Figure 5:
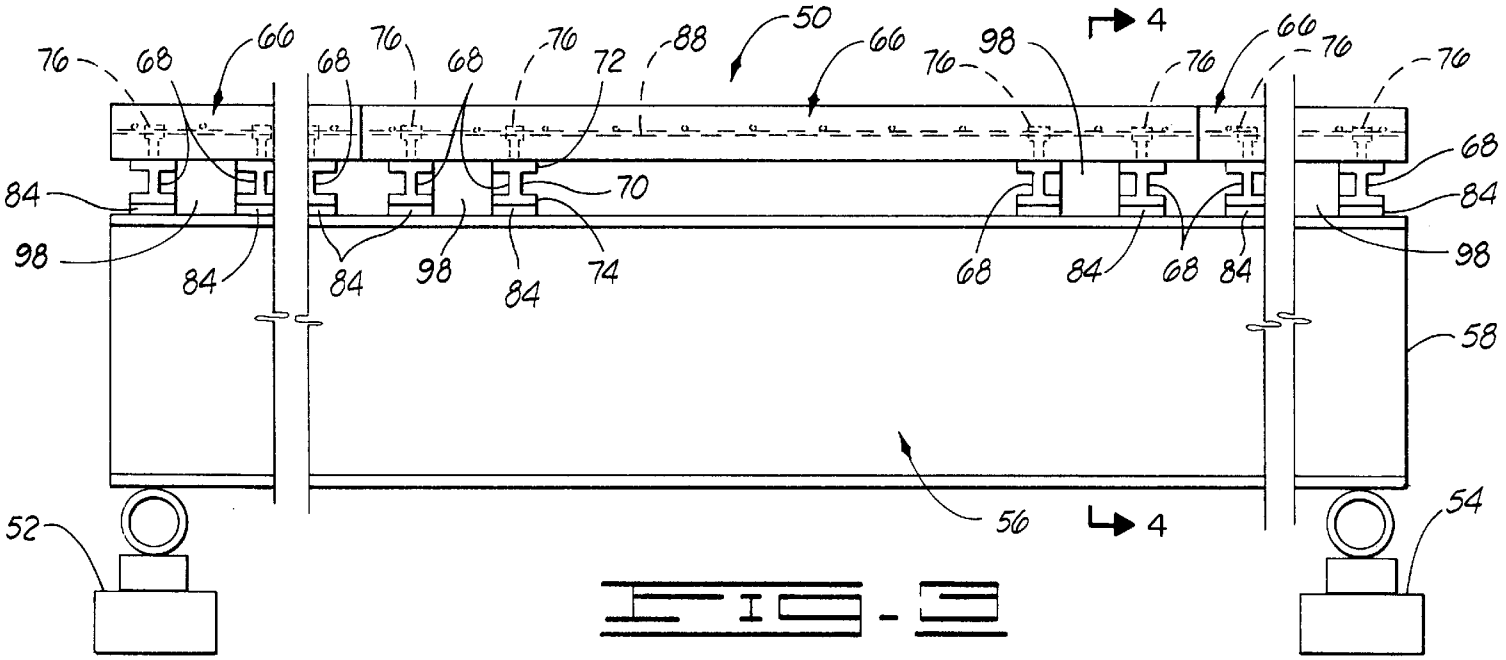
FIG. 5 is a partial plan view of a first embodiment of the composite structure showing a means of connecting a prefabricated composite unit to a girder.
Figure 6:
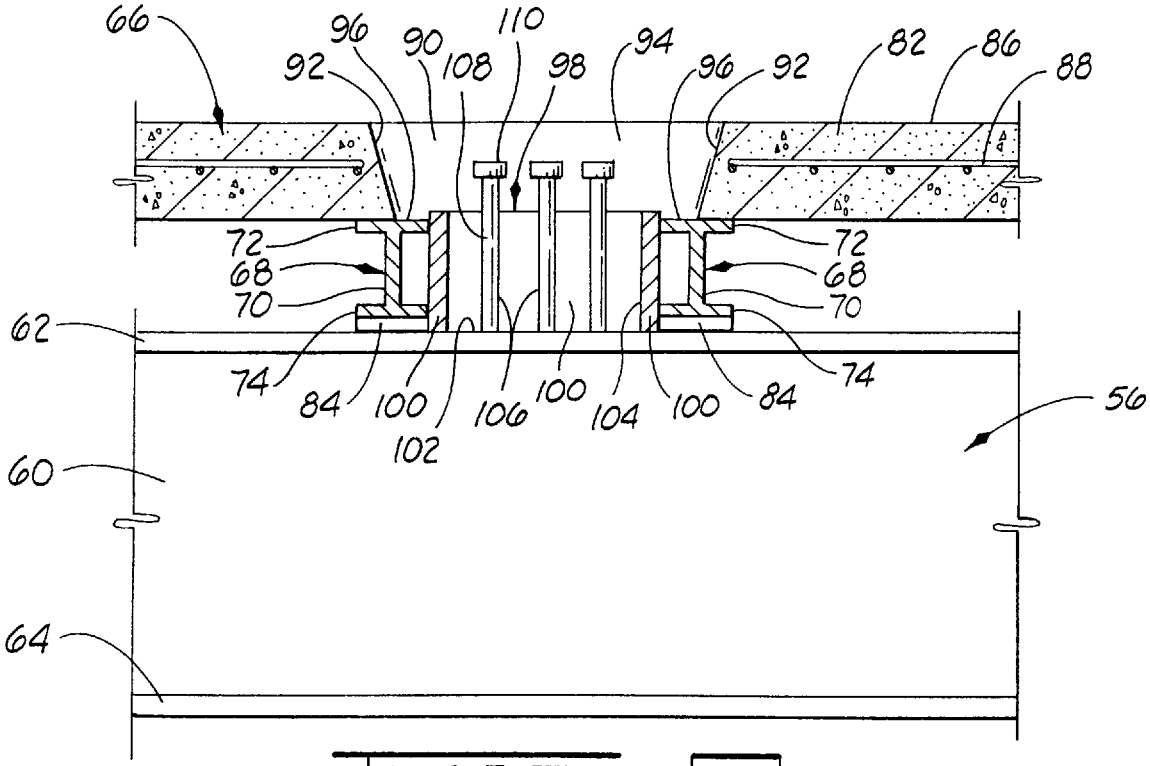
FIG. 6 is a cross section taken along lines 6—6 in FIG. 5.

Referring now also to FIGS. 5 and 6, one method of attaching composite units 66 to girders 56 is shown. In this embodiment, an opening 90 is formed in deck portion 82 adjacent to and between a pair of beams 68 at a location generally above a corresponding girder 56. Opening 90 is defined by a plurality of tapered side walls 92 and 94. An upwardly facing surface 96 on upper flanges 72 of beams 68 partially close a lower portion of opening 90 adjacent to side walls 92.

A tubular bulkhead 98 is disposed between flanges 72. In the embodiment shown, but not by way of limitation, bulkhead 98 is a tubular member having a substantially square cross section formed by a plurality of walls 100. Bulkhead 98 rests on upper surface 102 of upper flange 62 of girder 56, and the bulkhead extends upwardly into a lower portion of opening 90 in deck 82. Thus, a central opening 104 defined in bulkhead 98 is in communication with opening 90 in deck 82.

A plurality of girder shear connectors 106 are fixedly attached to upper surface 102 of upper flange 62 of girder 56, and the girder shear connectors extend upwardly into opening 90 in deck 82 through and preferably above bulkhead 98. Each girder shear connector 106 preferably has a shank portion 108 with an enlarged head portion 110 at the outer end thereof, but other kinds of connectors generally known in the art may also be used.

A plurality of such openings 90, bulkheads 98 and girder shear connectors 106 are spaced along beams 68 and girders 56 as necessary. With composite units 66 so positioned, openings 90 in deck portion 82 and central opening 104 in bulkheads 98 are filled with a grouting material 108 (see FIG. 4), such as cement or concrete. Grouting material 108 flows around girder shear connectors 106, and when the grouting material hardens, it will be seen that composite units 66 are thus fixedly attached to girders 56.

Figure 7:
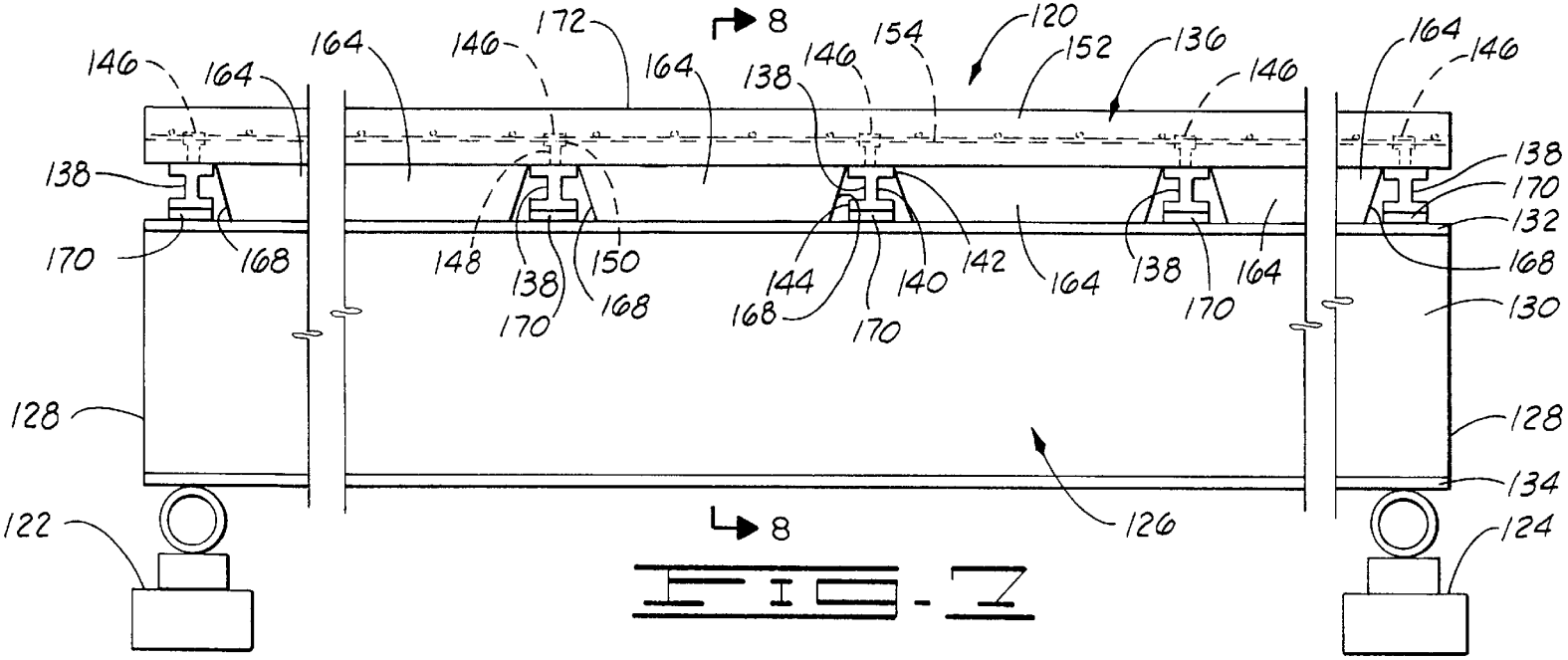
FIG. 7 shows an elevational view of a second embodiment of the composite structural member with thin deck portion of the present invention.
Figure 8:
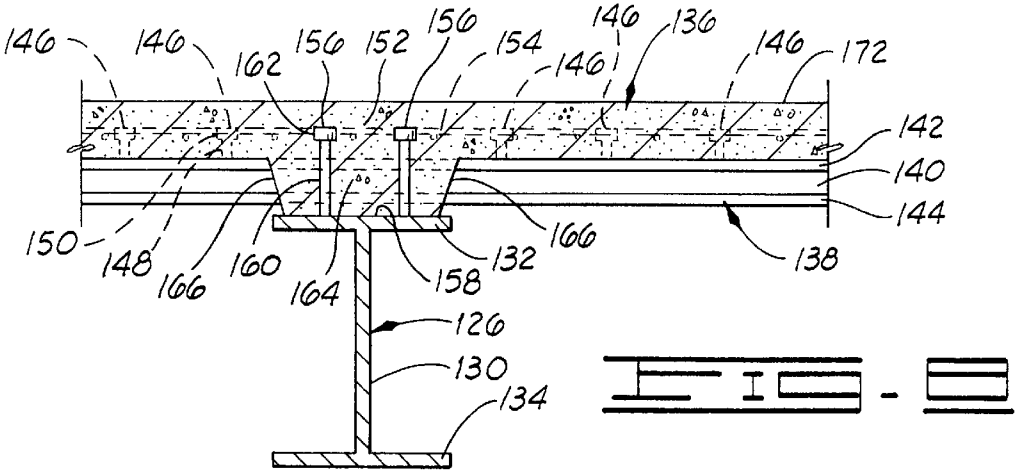
FIG. 8 is a partial cross section taken along lines 8—8 in FIG. 7.

Referring now to FIGS. 7 and 8, a second embodiment of the composite structural member with the thin deck portion of the present invention is shown and generally designated by the numeral 120. Again, structural member 120 is shown as a bridge structure positioned on a pair of known supports or abutments 122 and 124 which are of conventional type.

Member 120 comprises a plurality of longitudinally extending girders 126 which are supported on abutments 122 and 124 adjacent to longitudinal ends 128 of the girders. Each girder 126 has a vertically extending central portion 130 with upper and lower horizontal flange portions 132 and 134 on opposite sides thereof. It will be seen that girders 126 are substantially similar or identical to girders 56 in first embodiment structural member 50 or girders 16 in prior art structural member 10.

Structural member 120 also comprises a composite structural member or unit 136 positioned on upper flanges 132 of girders 126. Composite structural member 136 extends transversely between girders 126 and also longitudinally along the girders.

Composite member 136 comprises a plurality of transversely extending beams 138 which extend substantially the entire transverse width of member 136. Beams 138 are preferably of I-beam configuration having a vertically extending central portion 140 and upper and lower horizontal flange portions 142 and 144. Beams 138 are substantially identical to beams 68 in first embodiment structural member 50 and thus may also have a rectangular or square tube configuration.

Extending from the top of beams 138 are a plurality of beam shear connectors 146. Beam shear connectors 146 are fixedly attached to upper flanges 142 of beams 138. Each beam shear connector 146 preferably has a shank portion 148 with an enlarged head portion 150 at the outer end thereof, but other kinds of connectors generally known in the art may also be used.

Composite structural member 136 further comprises a molded deck portion 152. Molded deck portion 152 is made of concrete or similar material and is molded in place around beam shear connectors 146 on the upper flanges 142 of beams 138 to form the composite structure. Molds (not shown) of a kind known in the art are used to retain the concrete until it has hardened.

Deck portion 152 of structural member 136 is substantially thinner than prior art deck portions, such as deck 26 in prior art structural member 10. Deck portion 152 is sufficiently thin that only a single layer 154 of reinforcing material is required to add sufficient strength to the moldable material. Deck portion 152 is generally the same approximate thickness as deck portion 82 in first embodiment structural member 50.

A plurality of girder shear connectors 156 are fixedly attached to upper surface 158 of upper flanges 132 of girders 126. Each girder shear connector 156 preferably has a shank portion 160 with an enlarged head portion 162 at the outer end thereof, but other kinds of connectors generally known in the art may also be used.

Deck portion 152 has a plurality of downwardly extending support portions 164 which are above and adjacent to upper surface 158 of upper flanges 142 of girders 126. Support portion 164 is preferably integrally molded with the rest of deck portion 152 and has a plurality of side walls 166 and 168. As illustrated, side walls 166 and 168 taper inwardly and downwardly, but the invention is not intended to be limited to this particular configuration.

When pouring the moldable material to form deck portion 152, the mold (not shown) is shaped to also form support portions 164. Thus, it will be seen that the moldable material flows around girder shear connectors 156, and when the material hardens, composite structural member 136 is thus fixedly attached to girders 126 forming an additional composite connection.

At least one shim 170 is disposed between lower flange 144 of each beam 138 and upper flange 132 of the corresponding girders 126. The appropriate number of shims 170 is used so that upper flanges 142 of all of beams 138 are substantially aligned and coplanar. In this way, the deck thickness of deck portion 152, defined between upper surface 172 thereof and upper flanges 142 of beams 138 is substantially constant.

The key aspect of the present invention is that structural members 50 or 120 include relatively thin deck portions 82 or 152 which only needs a single layer of reinforcing material 88 or 154 therein, but which provides a composite unit 66 or structure 136 on top of girders 56 or 126 which is as strong or stronger than a corresponding prior art deck 26 on girders 16. A preferred thickness of deck portions 82 or 152 is in the range of approximately 4 inches to less than approximately 6.5 inches. Deck thicknesses less than about four inches, made with currently known materials, are believed to be too thin to have sufficient strength and durability characteristics. Further, conventional design philosophy calls for multiple layers of reinforcing material starting at thicknesses of about 6.5 inches and higher. As will be seen by the example below, one preferred thickness of deck portions 82 or 152 is approximately five inches on beams 68 or 138 having a height of approximately four inches.

EXAMPLE

The following calculations show a comparison of a prior art structural member 10 having a thickness of nine inches for deck portion 26 with girder 16 being a W40×215 I-beam (4-inch height, 215 pounds per foot) compared to a structural member 50 of the present invention having a composite unit 66 thickness of nine inches mounted on a girder 56 which is identical to girder 16. Haunch 30 in prior art structural member 10 is one inch thick, and the overall height of shims 84 in new structural member 50 is also one inch.

PRIOR ART

Girder 16 is a W40×215 I-beam, Grade 50 Steel:

Girder Span=83 feet

Girder moment of inertia, I=16,700 $in^4$

Girder section modulus, S=857 $in^3$

Composite Section:

9 in thick slab, 28 day ultimate strength of concrete, $f'_c$=6 ksi

Dead load weight of slab, DLw=1.228 klf

Composite section live load

Modular ratio, n=6

Composite section moment of inertia, I=46,339 $in^4$

Composite section bottom section modulus, $S_b$=1,233.3 $in^3$

Bottom fiber bending stress, $$f_b = \frac{1{,}057(12)}{857} + \frac{1236.5(12)}{1{,}233.3} = 26.83 \text{ ksi}$$

<27 ksi allowable for grade 50 steel.

NEW INVENTION

Girder 56 is a W40×215 I-beam, Grade 50 steel

Girder Span=94 feet

Girder moment of inertia, I=16,700 $in^4$

Girder section modulus, S=857 $in^3$

Composite Unit:

5 in. thick slab, $f'_c$=6 ksi 4 in. high beam

DLw=0.845 klf

Composite unit live load n=6

Composite unit moment of inertia, I=43,969 $in^4$

Composite unit section modulus, $S_b$=1,243.1 $in^3$ $$f_b = \frac{933.3(12)}{857} + \frac{1{,}422.9(12)}{1243.1} = 26.81 \text{ ksi}$$

Thus, the section modulus for the structural member of the present invention is greater than that for the prior art member 10 with the overall height being the same. This corresponds to a maximum live load bottom stress in the new structure which is less than that of the prior art. Thus, the present invention with its thin deck structure is stronger than the relatively thicker deck structure of the prior art.

Calculations for a similarly sized structural member 120 would be the same as for structural member 50.

This result is true even with variations in the size of girders 16 and 56, 126 as seen by the following table:

| | $f'_c$ = 6 ksi 5 in. slab, 4 in. beam, 1 in. shim | | $f'_c$ = 6 ksi 9 in. slab 1 in. haunch | |
|---|---|---|---|---|
| Girder Size | I, $in^4$ | $S_b$, $in^3$ | I, $in^4$ | $S_b$, $in^3$ |
| W30 × 90 | 13,969 | 436.7 | 14,067 | 434.4 |
| W36 × 135 | 25,606 | 724.6 | 26,234 | 717.9 |
| W40 × 149 | 30,843 | 833.3 | 31,831 | 825.8 |
| W40 × 249 | 49,573 | 1,428.1 | 52,780 | 1420.4 |

In each case, the section modulus for the present invention is higher than for the prior structure with a thicker slab.

Prior art structural member 10 is a very widely used bridge element. As previously discussed, deck 26 is poured in the field on forms supported by girders 16 which are almost always unshored. Therefore, girder 16 alone carries its self weight, the forms and the wet concrete poured to form deck 26. After the concrete hardens, shear connectors 32 cause girders 16 and a portion of deck 26 to act together as a composite structural member. It is this member that carries the live and impact loads and any superimposed dead loads that are attached to the hardened deck.

Consistent with this, the section properties and applied stresses have been calculated above for an eighty-foot span. Of particular note in these calculations is the DLW=1.228 klf, I=46,339 $in^4$ and $S_b$=1,233.3 $in^3$.

Structural members 50 and 120 of the present invention uses girders 56 and 126 which are the same as girder 16.

However, instead of a full depth nine-inch-thick deck 26, composite units 66 in structural member 50 or composite member 136 in structural member 120 have thinner sections, such as a five-inch-thick deck 82 or 152 and four-inch-high beams 68 or 138.

By any previously accepted engineering logic, the removal of the bottom four inches of a nine-inch-thick deck would reduce the composite section properties of a structural element since the beam occupying the four-inch space of the removed concrete is assumed to contribute nothing to the section properties in the direction of the span of the girder. However, this assumption is surprisingly incorrect as can be seen by comparing the calculations above in which the $S_b$ values for prior art structural member 10 and new structural members 50 and 120 show that the thinner decks 82 or 152 of the present invention have a value slightly higher, although the modulus of elasticity is approximately five percent lower. The latter is of minimal consequence since it is only involved in satisfying the deflection criteria which can be judiciously modified, whereas the section modulus for live load is used to satisfy the strength criteria for which there is no such latitude. The section modulus and moment of inertia relationship exists over a wide range of beam sizes as can be seen from the table above. Furthermore, the relationship moves even more in favor of the thinner deck 82 or 152 when an $f'_c$ of 4 ksi is used for the prior art structure. The latter is a field poured situation where it is very rare to use an $f'_c$ greater than 4 ksi. Using the latter $f'_c$, the live load section modulus and moment of inertia drop to 1,211.3 $in^3$ and 43,732 $in^4$, respectively.

One way to appraise the impact of this is to compare the design span lengths that result from the prior art structural member 10 and new structural member 50 or 120. As a result of slightly increasing the live load $S_b$ while significantly decreasing the dead load (1.228 klf to 0.845 klf), the design span length increases from 83 feet to 94 feet. A further implication of this improvement is that lower cost rolled beams may be used for girders 56 or 126 for longer spans instead of plate girders.

Another way to appraise the impact of the improved new design is to compare the girder sizes required for each solution for the same span. When this is done, the girder weight saved is about fifteen percent. The reduction in superstructure dead load is over thirty percent, which translates into lower sub-structure costs, especially in earthquake-problem areas where the lighter superstructure requires lower cost bridge piers.

The present invention is well adapted for use in refurbishing prior art structures, such as structural member 10 shown in FIGS. 1 and 2. Eventually, deck portion 26 will deteriorate and will need to be replaced. With conventional techniques, deck 26 is removed, and forms are again placed on girder 16 with moldable material such as concrete repoured into the forms. This certainly works, but the time necessary to install the forms, pour the new deck portion 26 and wait for the deck portion to harden sufficiently, takes a significant amount of time. Refurbishing the structure may instead be done by incorporating either first embodiment structural member 50 or second embodiment structural member 120 of the present invention.

For second embodiment structural member 120, beams 136 are positioned as desired, and the mold necessary to form deck portion 152 is installed. The moldable material, such as concrete, is then poured into the mold to form deck portion 152 including support portions 164 integral therewith. In this case, the molds are smaller and easier to handle than the molds necessary for the thicker deck portion 26 of prior art structural member 10, and the time necessary for thinner deck portion 152 to harden is less than that for prior art deck portion 26. Thus, the time necessary to reconstruct a bridge in the configuration of second embodiment structural member 120 is less than for previously known structures. This is particularly important in cases such as where structural members 10 are bridges which carry heavy traffic loads, the interruption in traffic flow is inconvenient to the motoring public.

In cases where in the interruption of traffic flow is particularly critical, even less disruption is possible utilizing the prefabricated composite units of first embodiment structural member 50. That is, after deck portion 26 is removed, composite units 66 may be placed in their positions on girders 16 and attached to the girders in the way previously described. While composite units 66 also may be poured in place, as previously mentioned, the best procedure is to prefabricate composite units 66 and transport them to the site. As soon as a portion of deck 26 is removed, composite units 66 may be immediately placed in position on girder 16 and attached to girder 16. This eliminates the time necessary to position new forms on girder 16 or beams 68 and pour the concrete. The time necessary to cure the grouting material used to fill openings 90 and central openings 104 is also considerably less than that necessary to cure an entire concrete deck, particularly the thicker deck of prior art structure 10.

Thus, the present invention provides a stronger structure than the prior art it is replacing, while greatly reducing the amount of time necessary to do the refurbishment, particularly for first embodiment structural member 50. The reduction in time greatly reduces the amount of inconvenience to the motoring public which results in virtually immeasurable savings in time and costs to the public in addition to the easily calculable savings in building the structure.

It will be seen, therefore, that the composite structure with thin deck portion of the present invention is well adapted to carry out the ends and advantages mentioned as well as those inherent therein. While presently preferred embodiments of the apparatus have been described for the purposes of this disclosure, numerous changes in the arrangement and construction of parts may be made by those skilled in the art. All such changes are encompassed within the scope and spirit of the appended claims.

What is claimed is:

1. A structural apparatus comprising:

a plurality of girders extending in a longitudinal direction, said girders being spaced from one another in a transverse direction with respect to said girders;

a composite member disposed above said girders, said composite member comprising:

a plurality of beams extending in said transverse direction;

a plurality of beam shear connectors attached to said beams;

a layer of reinforcing material; and a molded deck portion molded around said beam shear connectors and said reinforcing material, said deck portion being disposed substantially above said beams;

wherein, a thickness of said molded deck portion and a height of said beams are selected such that said composite member has a section modulus greater than a section modulus of a molded deck having a thickness equal to the thickness of said molded deck portion plus the height of said beams; and means for connecting said composite member to said girders.

2. The apparatus of claim 1 wherein said deck portion is made of concrete.

3. The apparatus of claim 1 wherein said deck portion has a thickness in the range of 4 inches to less than 6.5 inches.

4. The apparatus of claim 1 wherein said deck portion has a thickness of approximately five inches.

5. The apparatus of claim 1 wherein said composite member is one of a plurality of composite members disposed adjacent to one another above said girders.

6. The apparatus of claim 5 wherein said composite members are prefabricated.

7. The apparatus of claim 6 wherein said composite members are formed in an inverted position.

8. The apparatus of claim 1 wherein:

said means for connecting comprises a girder shear connector connected to each girder; and said molded deck portion comprises a downwardly extending support portion molded around said girder shear connector and engaging said girders.

9. The apparatus of claim 1 further comprising a shim disposed between each of said beams and corresponding girders.

10. A structural apparatus comprising:

a plurality of substantially parallel, spaced girders extending in a longitudinal direction;

a composite member disposed above said girders, said composite member comprising:

a plurality of beams extending in a transverse direction with respect to said girders;

a plurality of beam shear connectors attached to said beams; and a molded deck portion molded around said beam shear connectors, said deck portion being disposed substantially above said beams and having a thickness in the range of 4 inches to less than 6.5 inches; and means for connecting said composite member to said girders.

11. The apparatus of claim 10 wherein said deck portion has a thickness of about five inches.

12. The apparatus of claim 10 wherein said deck portion is made of concrete.

13. The apparatus of claim 10 wherein said composite member is one of a plurality of composite members disposed adjacent to one another above said girders.

14. The apparatus of claim 13 wherein said composite members are prefabricated.

15. The apparatus of claim 14 wherein said composite members are formed in an inverted position.

16. The apparatus of claim 10 wherein:

said means for connecting comprises a girder shear connector connected to each girder; and said molded deck portion comprises a downwardly extending support portion molded around said girder shear connector and engaging said girders.

17. The apparatus of claim 10 further comprising a shim disposed between each of said beams and corresponding girders.

18. A method of refurbishing a structural apparatus having an original molded deck portion disposed above and connected to a plurality of longitudinally extending girders, said method comprising the steps of:

prefabricating a plurality of composite units, each composite unit comprising:

a plurality of substantially parallel beams;

a plurality of beam shear connectors attached to said beams; and a molded unit deck portion molded around said beam shear connectors, each of said unit deck portions being disposed substantially above said beams, wherein a thickness of said molded unit deck portions and a height of said beams is selected such that a section modulus of said composite units is greater than a section modulus of said original molded deck portion;

removing the original deck portion;

positioning said composite units on said girders such that said beams extend in a transverse direction with respect to said girders, said composite units being positioned adjacent to one another such that said unit deck portions thereof form a substantially continuous upper surface; and attaching said composite units to said girders.

19. The method of claim 18 wherein a height of said composite units is approximately equal to a height of said original deck portion.

20. The method of claim 18 wherein said unit deck portion has a thickness in the range of 4 inches to less than 6.5 inches.

21. The method of claim 18 wherein said step of prefabricating comprises molding said unit deck portions with a single layer of reinforcing material therein.

22. The method of claim 18 wherein the step of attaching comprises filling an opening in each of said unit deck portions with grouting material such that said grouting material substantially surrounds girder shear connectors attached to said girders and extending into corresponding ones of said openings.

23. The method of claim 18 further comprising positioning a shim between each of said beams and the corresponding girders.

24. The method of claim 18 wherein said step of prefabricating comprises forming said composite units in an inverted position.

25. A method of refurbishing a structural apparatus having an original molded deck portion disposed above and connected to a plurality of longitudinally extending girders, said method comprising the steps of:

removing the original deck portion;

positioning a plurality of substantially parallel beams on said girders such that said beams extend in a transverse direction with respect to said girders, said beams having a plurality of beam shear connectors attached thereto;

molding a new deck portion around said beam shear connectors and substantially above said beams, said new deck portion and beams together having a section modulus greater than a section modulus of said original molded deck portion and having a height no greater than a height of said original molded deck portion; and attaching said new deck portion to said girders.

26. The method of claim 25 wherein a combined height of said new deck portion and said beams is approximately equal to a height of said original deck portion.

27. The method of claim 25 wherein said new deck portion has a thickness in the range of 4 inches to less than 6.5 inches.

28. The method of claim 25 wherein:

the step of attaching comprises attaching a plurality of girder shear connectors to said girders; and said step of molding comprises molding a downwardly extending support portion of said deck portion around said girder shear connectors.

29. The method of claim 25 further comprising positioning a shim between each of said beams and the corresponding girders.

30. A structural apparatus comprising:

a plurality of girders extending in a longitudinal direction, said girders being spaced from one another in a transverse direction with respect to said girders;

a plurality of composite members disposed above said girders, each of said composite members comprising:

a plurality of beams extending in said transverse direction;

a plurality of beam shear connectors attached to said beams;

a layer of reinforcing material; and a molded deck portion molded around said beam shear connectors and said reinforcing material, said deck portion being disposed at least partially above said beams;

wherein, said deck portions of said composite members define a plurality of openings therein, each opening being aligned with a gap defined between a pair of adjacent beams; and means for connecting said composite members to said girders and comprising:

a bulkhead disposed in each of said gaps and aligned with a corresponding one of said openings;

a girder shear connector attached to each girder and extending into corresponding ones of said bulkheads and openings; and a grouting material filling said bulkheads and openings and surrounding said girder shear connectors.

31. A structural apparatus comprising:

a plurality of substantially parallel, spaced girders extending in a longitudinal direction;

a plurality of composite members disposed above said girders, each of said composite units comprising:

a plurality of beams extending in a transverse direction with respect to said girders;

a plurality of beam shear connectors attached to said beams; and a molded deck portion molded around said beam shear connectors, said deck portion being disposed at least partially above said beams and having a thickness in the range of 4 inches to less than 6.5 inches;

wherein, said deck portions of said composite members define a plurality of openings therein, each opening being aligned with a gap defined between a pair of adjacent beams; and means for connecting said composite members to said girders and comprising:

a bulkhead disposed in each of said gaps and aligned with a corresponding one of said openings;

a girder shear connector attached to each girder and extending into the corresponding ones of said bulkheads and openings; and a grouting material filling said bulkheads and openings and surrounding said girder shear connectors.

* * * * *